52-222 SP
5/15/87 OR 4,665,671

United States Patent [19]

Sarvis

[11] Patent Number: 4,665,671

[45] Date of Patent: May 19, 1987

[54] METHOD FOR ASSEMBLING AN AWNING

[75] Inventor: Daniel P. Sarvis, San Antonio, Tex.

[73] Assignees: American Floor Covering Company; American Awning & Shade Shop, Inc., both of San Antonio, Tex.

[21] Appl. No.: 845,888

[22] Filed: Mar. 28, 1986

[51] Int. Cl.[4] ..... E04B 1/00

[52] U.S. Cl. ..... 52/222; 52/74; 52/273; 160/395

[58] Field of Search ..... 52/74, 222, 273, 63; 160/76, 380, 395, 399

[56] References Cited

U.S. PATENT DOCUMENTS

| | | | |
|---|---|---|---|
| 2,380,348 | 7/1945 | Wagstaff | 52/222 X |
| 2,950,727 | 8/1960 | Dunn | 52/74 X |
| 3,100,012 | 8/1963 | Dunn | 52/74 X |
| 3,273,633 | 9/1966 | Seidmon et al. | 160/395 X |
| 3,483,879 | 12/1969 | Oehmsen | 160/395 X |
| 3,788,216 | 1/1974 | Lambert | 160/395 X |
| 3,930,344 | 1/1976 | Gahler | 52/63 X |
| 4,007,552 | 2/1977 | Brooks . | |
| 4,192,112 | 3/1980 | Reilly, Sr. | 52/222 |
| 4,214,411 | 7/1980 | Pickett | 52/222 X |
| 4,265,039 | 5/1981 | Brooks . | |
| 4,452,000 | 6/1984 | Gandy . | |

FOREIGN PATENT DOCUMENTS

| | | |
|---|---|---|
| 1021565 | 11/1977 | Canada . |
| 1149159 | 7/1983 | Canada . |
| 1156457 | 11/1983 | Canada . |

OTHER PUBLICATIONS

Signtech SIA—Series Advertisement—advertises an Illuminated Awning System.

Signtech Flexface brochure—describes a Tensioning System.

ABC Tensioning Flexible Faces—illustrates a Tensioning Apparatus.

*Primary Examiner*—Carl D. Friedman

*Attorney, Agent, or Firm*—Sisson & Smith

[57] ABSTRACT

Method for assembling an awning, including method for tensioning awning material about an awning frame. The awning material is secured to the top rear of the frame and stretched over the bottom front and each bottom side of the frame. Pieces of spline are thereafter placed atop the material and pressed into slots defined by frame members on the bottom front and bottom sides of the frame. Keeper members are thereafter inserted into the slots in abutting engagement with the spline and are secured to the inner frame members.

10 Claims, 8 Drawing Figures

METHOD FOR ASSEMBLING AN AWNING

BACKGROUND OF THE INVENTION

The present invention relates to a method for assembling an awning, including a method for tensioning the material from which the awning is constructed.

Awnings have grown in popularity in recent years. A conventional awning typically includes a welded frame having canvas, nylon, or vinyl material stretched thereover. One end of the awning material is sewn about a piece of spline and inserted into awning head-rail secured to the frame. In one type of awning, the opposite end of the material is secured to the frame by rope or line which extends through eyelets in the material and about the frame. The frame is thereafter secured to a building facade or other structure in a conventional manner.

One type of awning which has grown in popularity is the back lit awning. In this type of awning, vinyl-coated nylon material is stretched over a skeletal frame and a light source is placed within the frame behind the material, thereby illuminating the awning. Angle members secured to the frame may be utilized to support a piece of clear or shaded plastic or light diffuser material on the bottom of the awning. It is extremely important in a back lit awning that the vinyl-coated nylon material be as taut as possible about the skeletal frame, thereby providing an aesthetically pleasing awning structure which is properly illuminated.

SUMMARY OF THE INVENTION

Accordingly, the present invention provides a method for assembling an awning, including a method for tensioning or tightening the awning material stretched over the awning frame. An awning assembled in accordance with the present invention is also disclosed.

The method of the present invention comprises the steps of assembling a skeletal frame and securing the awning material thereto. When the frame is assembled, a pair of frame members on the bottom front and each bottom side of the frame define a slot or groove between each pair of frame members. The awning material is secured to the top rear of the frame by sewing one end of the material about a spline and inserting the spline and respective end of the awning material into a slot in a C-shaped head-rail member secured to the top rear of the frame.

Once the first end of the awning material is secured to the top rear of the frame, the remainder of the awning material is spread over the frame and secured to the bottom front and each bottom side of the frame. The awning material is stretched over the bottom front and each bottom side of the frame and a plurality of pieces of spline are thereafter placed atop the material and pressed into the slots between the frame members on the bottom front and bottom sides of the frame. A plurality of angled keeper members are thereafter inserted into the slots in abutting engagement with the spline and are secured to the inner frame members on the bottom front and bottom sides of the frame. The assembled awning may thereafter be secured to a building facade or other structure in a conventional manner.

It is to be understood that when the spline is inserted into the slots between the pair of frame members on the bottom front and bottom sides of the frame, the awning material will be initially stretched or tightened about the awning frame. The awning material will thereafter be tightened to a further degree when the keeper members are inserted into the slots against the spline. A final tightening of the awning material occurs when the keeper members are secured to the inner frame members. The present invention thus provides a method for assembling an awning, including a method of tensioning the awning material about the awning frame, which is both convenient and economical to utilize, and which provides an aesthetically appealing awning structure.

DETAILED DESCRIPTION OF THE PREFERRED EMBODIMENT

Figure 1:
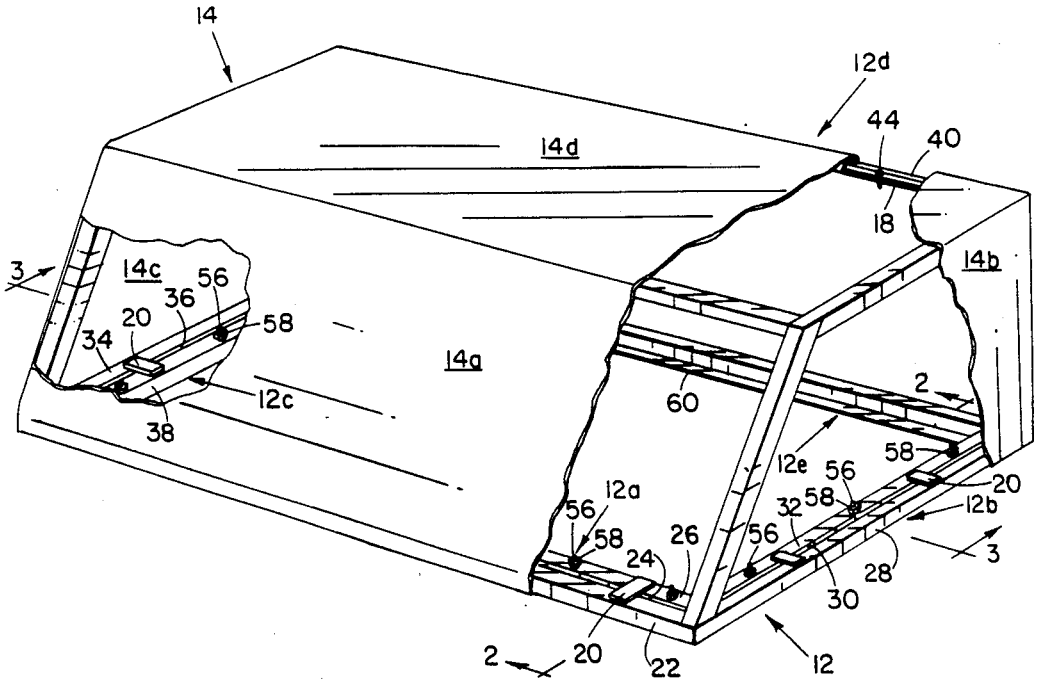
FIG. 1 is a perspective view of an upright awning assembled in accordance with the preferred embodiment of a method for assembling an awning.

An awning assembled in accordance with the present invention is illustrated in FIG. 1, with portions of the awning material cut away for purposes of clarity. The awning comprises a skeletal frame 12 having material 14 secured thereto. The frame 12 has a bottom front **12*a*, a bottom right side 12*b*, a bottom left side 12*c*, a top rear 12*d*, and a bottom rear 12*e*. When the awning material 14 is secured about the frame 12, material 14 defines a front wall 14*a*, right side wall 14*b*, left side wall 14*c*, and top wall 14*d*. Awning material 14** is preferably canvas or vinyl-coated nylon.

Figure 4:
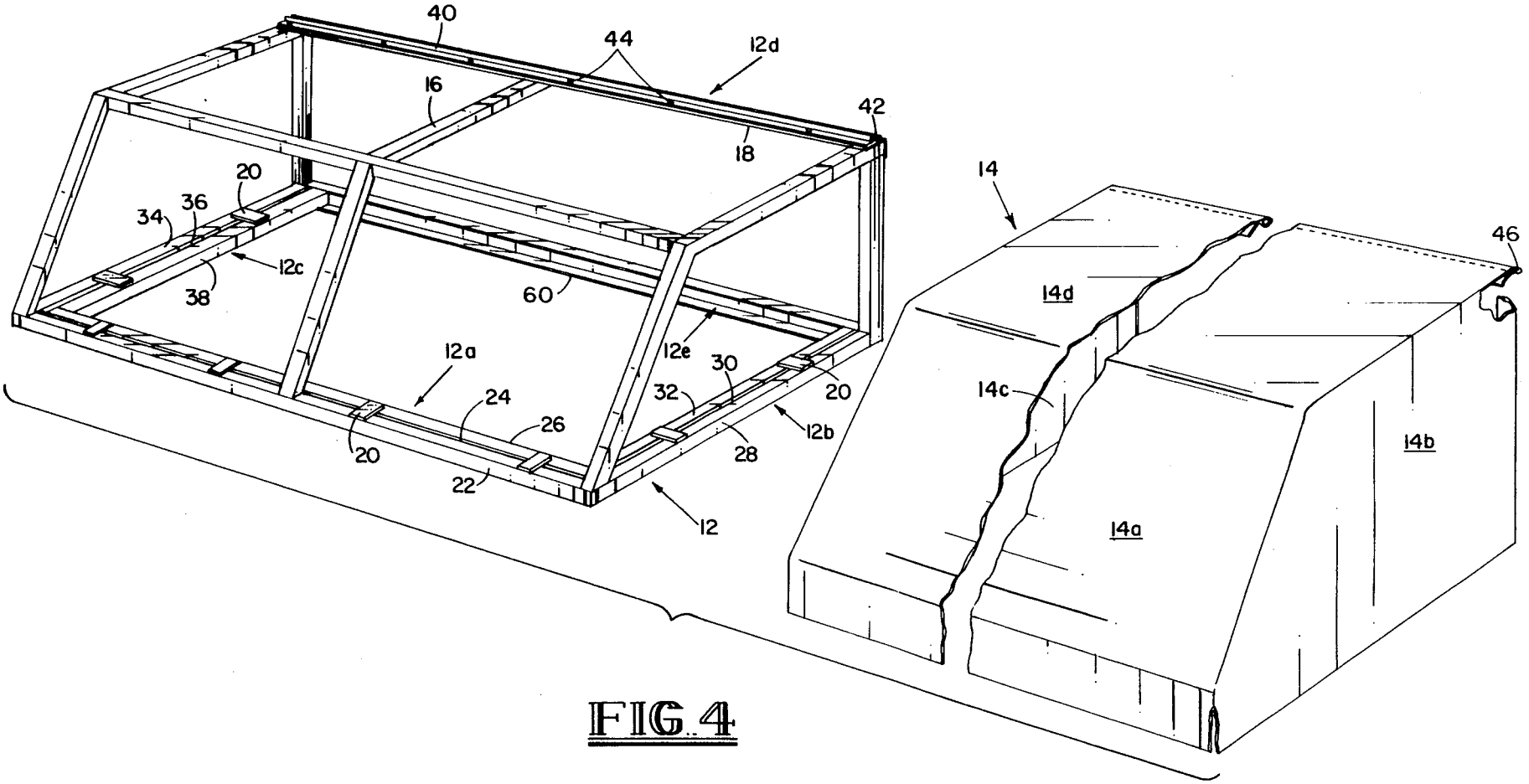
FIG. 4 is a perspective view of a frame and awning material illustrating the preferred embodiment of a method for assembling an awning.

As illustrated in FIG. 1 and FIG. 4, the frame 12 is preferably constructed of a plurality of frame members, including a center truss 16 and a right angle member 18 along the top rear **12*d*, which are preferably welded together in a conventional manner. Further, bottom front 12*a*, bottom right side 12*b*, and bottom left side 12*c* are each provided with a pair of substantially parallel frame members which are secured together by weld plates 20. Bottom front 12*a* is provided with an outer tubular member 22 and an inner tubular member 26 defining a slot or groove 24 therebetween. Bottom right side 12b is provided with an outer tubular member 28 and an inner tubular member 32 defining a slot or groove 30 therebetween. Bottom left side 12c is provided with an outer tubular member 34 and an inner tubular member 38 defining a slot or groove 36 therebetween. Frame member 26 is preferably welded to frame members 32 and 38. Frame members 32 and 38 are preferably welded to the bottom rear 12e of frame 12**.

Figure 2:
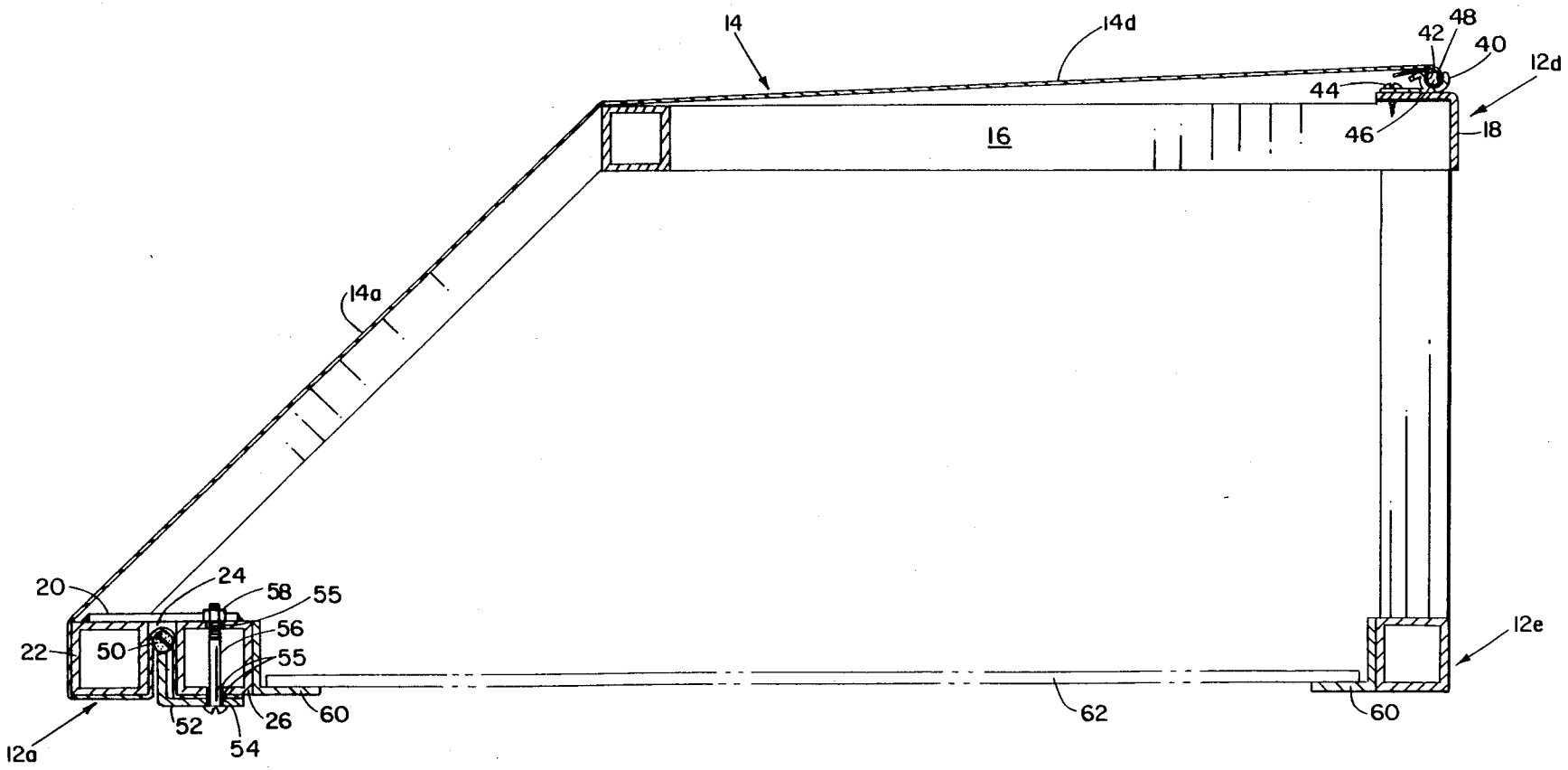
FIG. 2 is a cross sectional view, taken along section lines 2—2 of FIG. 1, of an upright awning assembled in accordance with the preferred embodiment of a method for assembling an awning.

As illustrated in FIG. 2 and FIG. 4, a C-shaped awning head-rail 40 having a groove 42 therein is attached to angle 18 by a plurality of sheet metal screws 44. As further illustrated in FIG. 2 and FIG. 4, an end of material 14 is wrapped around a nylon spline rod 46 with the referenced end of material 14 sewn so as to form a passage 48 within which to receive spline 46. The referenced end of material 14 sewn about spline 46 is thereafter secured to the top rear 12d of frame 12 by sliding spline 46 (with material 14 secured thereabout) into groove 42. Once the referenced end of material 14 is secured to frame 12, as described hereinabove, the remainder of material 14 is thereafter spread over frame 12, as illustrated in FIG. 1. It is to be understood, however, that material 14 will preferably be precut and preshaped prior to being secured to head-rail 40 and spread over frame 12.

Figure 6:
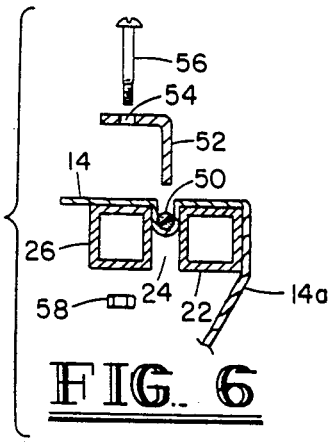
FIG. 6 is a cross sectional view, taken along section lines 6—6 of FIG. 5, illustrating a step in the preferred embodiment of a method for tightening awning material about an awning frame.
Figure 5:
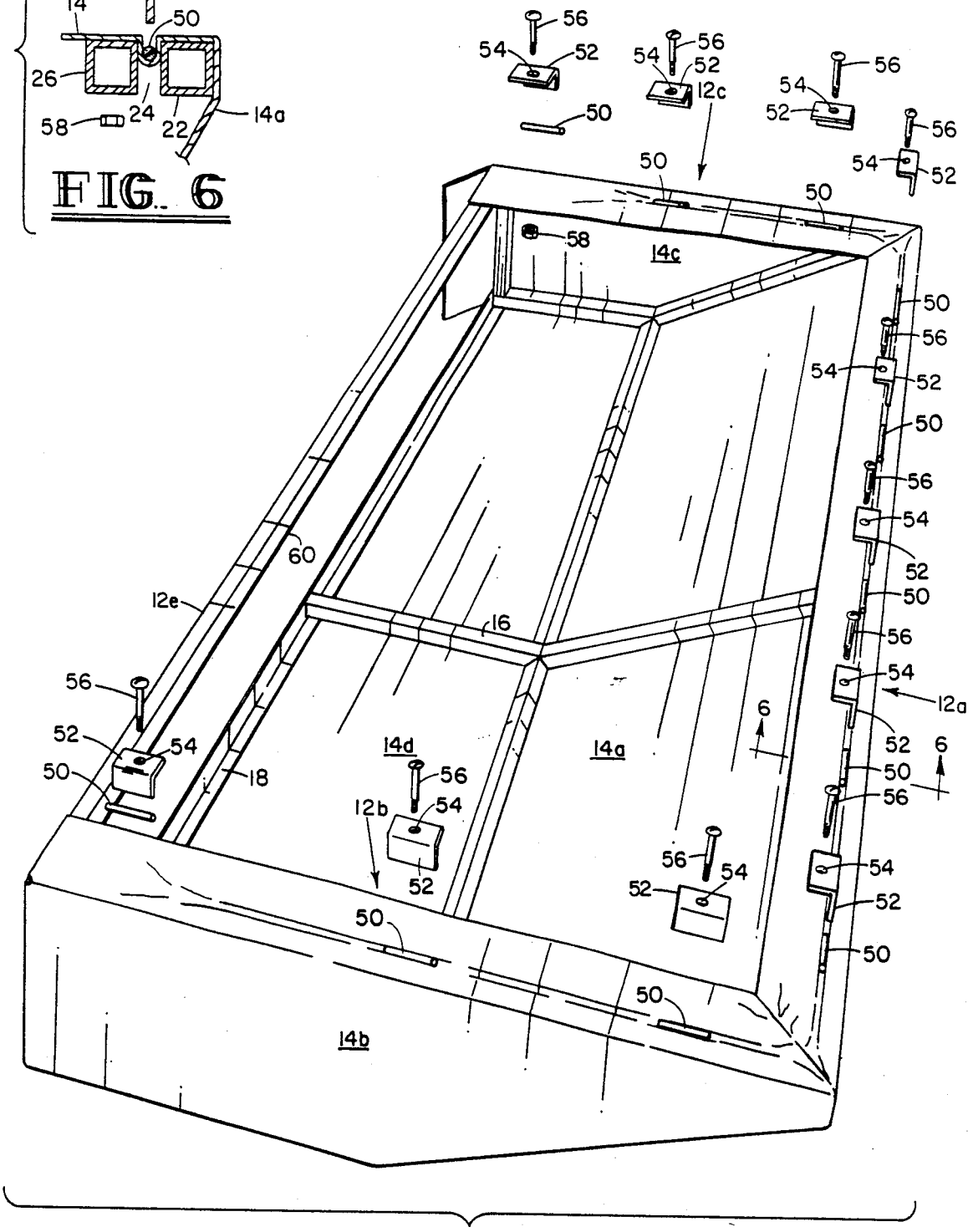
FIG. 5 is a bottom perspective view illustrating the preferred embodiment of a method for assembling an awning, including a method for tightening awning material about an awning frame.

The method for securing the respective remaining ends of material 14 to bottom front 12a and bottom sides 12b and 12c is illustrated in FIG. 2, FIG. 3, and FIG. 5–FIG. 8. As illustrated in FIG. 5, the material 14 is stretched over bottom front 12a, bottom side 12b, *and bottom side 12c*, and the respective grooves 24, 30, and 36. Pieces of spline, such as nylon spline 50, are thereafter placed over material 14 at spaced intervals along the length of bottom front 12a and inserted into groove 24, as illustrated in FIG. 5 and FIG. 6, thereby urging material 14 into groove 24 and tightening material 14 along top wall 14d and front wall 14a. Pieces of nylon spline 50 are also placed over material 14 at spaced intervals along the length of bottom side 12b and inserted into groove 30, as illustrated in FIG. 5, thereby urging material 14 into groove 30 and tightening material 14 along top wall 14d and side wall 14b. Pieces of nylon spline 50 are also placed over material 14 at spaced positions along the length of bottom side 12c and inserted into groove 36, as illustrated in FIG. 5, thereby urging material 14 into groove 36 and tightening material 14 along top wall 14d and side wall 14c. In the preferred embodiment, spline pieces 50 are initially inserted to a depth of approximately one fourth ($\frac{1}{4}$) the depth of the respective grooves 24, 30, and 36, as illustrated in FIG. 6, thereby providing a first or initial tensioning of material 14. Further, the insertion of spline pieces 50 preferably begins in approximately the center of bottom front 12a and proceeds in each direction therefrom toward the rear of bottom sides 12b and 12c, as illustrated in FIG. 5.

Figure 8:
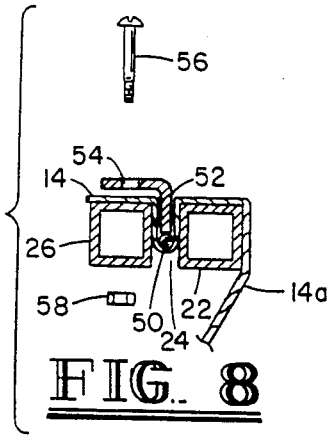
FIG. 8 is a cross sectional view, taken along section lines 8—8 of FIG. 7, illustrating a step in the preferred embodiment of a method for tightening awning material about an awning frame.
Figure 7:
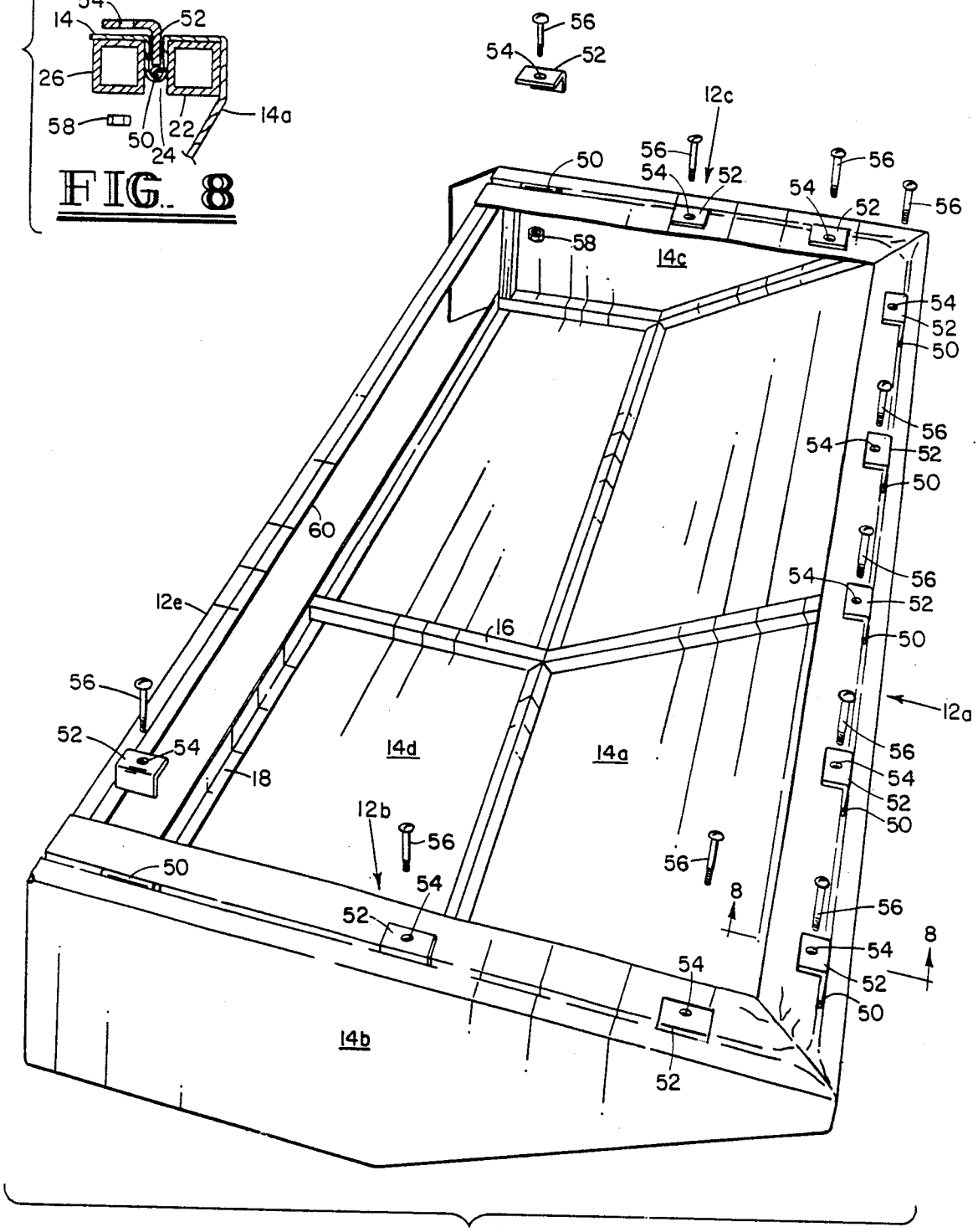
FIG. 7 is a bottom perspective view illustrating the preferred embodiment of a method for assembling an awning, including a method for tightening awning material about an awning frame.

Once the spline pieces 50 are inserted into grooves 24, 30, and 36, right angle keeper members 52 are inserted therein, as illustrated in FIG. 7 and FIG. 8, thereby urging spline pieces 50 and material 14 to a depth of approximately three fourths ($\frac{3}{4}$) the depth of the respective grooves 24, 30, and 36, and providing a second or further tensioning of material 14. That is, an angled keeper member 52 is inserted into groove 24 against each piece of spline 50 within groove 24, as illustrated in FIG. 7 and FIG. 8, thereby further tightening material 14 across top 14d and front 14a. An angled keeper member 52 is also inserted into groove 30 against each piece of spline 50 within groove 30, as illustrated in FIG. 7, thereby further tightening material 14 across top 14d and side wall 14b. Finally, an angled keeper member 52 is inserted into groove 36 against each piece of spline 50 within groove 36, as illustrated in FIG. 7, thereby further tightening material 14 across top 14d and side wall 14c. Insertion of keeper members 52 likewise preferably begins in approximately the center of bottom front 12a and proceeds in each direction therefrom toward the rear of bottom sides 12b and 12c, as illustrated in FIG. 7.

Figure 3:
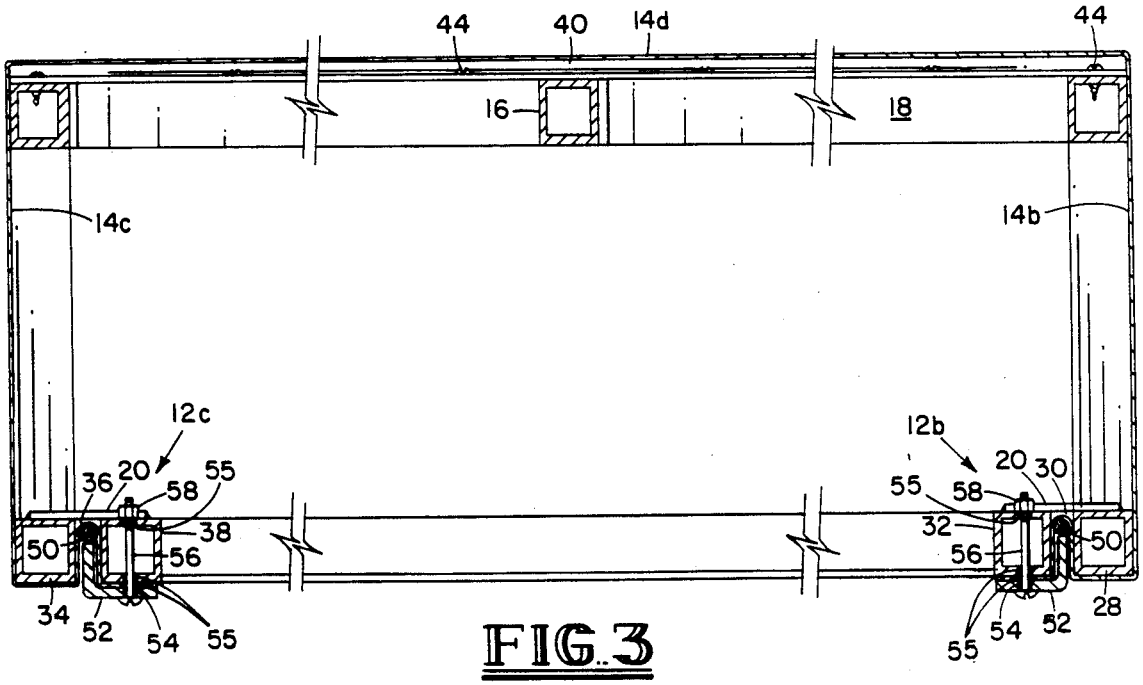
FIG. 3 is a cross sectional view, taken along section lines 3—3 of FIG. 1, of an upright awning assembled in accordance with the preferred embodiment of a method for assembling an awning.

Once the keeper members 52 are inserted in grooves 24, 30, and 36, keeper members 52 are secured to inner frame members 26, 32, and 38, respectively, as illustrated in FIG. 2 and FIG. 3. Securement of keeper members 52 to the respective inner frame members 26, 32, and 38, is preferably accomplished by drilling a passage 55 through material 14 and the respective frame members 26, 32, and 38 in alignment with the hole 54 in each keeper member 52. A bolt 56 is thereafter inserted through each hole 54 and the drilled passage 55 in material 14 and frame members 26, 32, and 38, with each bolt 56 thereafter secured to frame members 26, 32, and 38 by a nut 58, as illustrated in FIG. 2 and FIG. 3. Securement of keeper members 52 to the respective inner frame members 26, 32, and 38 urges spline pieces 50 and material 14 to a greater depth within the respective grooves 24, 30, and 36 and provides a third or final tensioning of material 14, with the tightening of nuts 58 on bolts 56 providing a mechanical advantage in further tensioning material 14. That is, securement of keeper members 52 to inner frame member 26 further tightens material 14 across top 14d and front 14a. Securement of keeper members 52 to inner frame member 32 further tightens material 14 across top 14d and side wall 14b. Securement of keeper members 52 to inner frame member 38 further tightens material 14 across top 14d and side wall 14c. Finally, the securement of keeper members 52 preferably begins in approximately the center of bottom front 12a and proceeds in each direction therefrom toward the rear of bottom sides 12b and 12c.

It is to be understood that the width of grooves 24, 30, and 36 is approximately three-sixteenths inch (3/16″) and that the diameter of spline pieces 50 is approximately one-quarter inch ($\frac{1}{4}$″), thereby requiring the use of Vise Grips or another instrument to insert spline pieces 50 into grooves 24, 30, and 36. However, the tight interference fit of spline pieces 50 within grooves 24, 30, and 36 assures that the material 14 will be drawn taut upon insertion of spline pieces 50 and adequately secured to the bottom front 12a and bottom sides 12b and 12c of frame 12. In the preferred embodiment, tubing for frame 12 has a width of approximately one inch (1″) and spline pieces 50 have a length of approximately four inches (4″). Further, keeper members 52 are preferably aluminum, preferably have a length of approximately three inches (3″), a depth of approximately one inch (1″), and are preferably spaced approximately eight inches (8″) apart. Finally, it is to be understood that each step of tensioning material 14, as described hereinabove, will stretch material 14 to a further degree. For example, if material 14 has a length of approximately seven feet (7′) from head-rail 40 to bottom front 12a and a stretch coefficient of approximately one eighth inch ($\frac{1}{8}$″) per foot, material 14 will ultimately be stretched approximately seven eights inch ($\frac{7}{8}$″) upon completion of the awning assembly.

It is to be understood that other types of spline or sturdy resilient matter, such as pieces of hard, solid rubber or soft wood, such as pine, may be readily substituted for nylon spline pieces 50. It is also to be understood that any material 14 overlapping the rear of frame 12 may simply be folded back or screwed to frame 12. It is also to be understood that once the material 14 is properly secured to frame 12, material 14 may be trimmed and the awning may be secured to a building facade or other structure in a conventional manner, such as by wood screws, bolts, or expansion screws. Finally, if the assembled awning is intended to be utilized as a back lit awning, a pair of angles 60 may be welded or otherwise appropriately connected to inner frame member 26 and the bottom rear **12*e* of frame 12 in a manner sufficient to support a piece of clear or shaded plastic or light diffuser material 62, as illustrated in FIG. 2**.

While the method for assembling an awning has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

I claim:

1. An awning, comprising:

a frame having a groove therein;

means for securing a first end of awning material to said frame; and means for securing a second end of said awning material to said frame and achieving a stepped tensioning of said awning material comprising:

a piece of spline adapted for insertion into said groove to a first depth in said groove, said inserting of said spline into said groove urging a portion of said second end of said awning material into said groove and achieving an initial tensioning of said awning material;

a keeper member adapted for insertion into said groove to abut said piece of spline, said abutting of said spline urging said spline to a second dept within said groove deeper than said first depth and achieving a further tensioning of said awning material; and means for securing said keeper member to said frame, said securing of said keeper member urging said spline to a third depth within said groove deeper than said second depth and achieving a final tensioning of said awning material.

2. An awning, as recited in claim 1, wherein said spline is nylon.

3. An awning, as recited in claim 1, wherein said spline is rubber.

4. An awning, as recited in claim 1, wherein said spline is wood.

5. A method for tensioning awning material, comprising the steps of:

(a) securing a first end of said material to a first portion of a frame;

(b) stretching said material over a second portion of said frame; and (c) securing a second end of said material to said second portion of said frame, comprising the steps of:

i. placing a piece of spline over a portion of said second end of said material;

ii. inserting said spline into a groove in said frame to a first depth in said groove, thereby inserting said portion of said second end of said material into said groove in said frame, said spline insertion step achieving an initial tensioning of said material;

iii. inserting a keeper member into said groove in said frame so as to abut said spline and urge said spline to a second depth within said groove deeper than said first depth, said keeper member insertion step achieving a further tensioning of said material; and iv. securing said keeper member to said frame, said keeper member securement step urging said spline to a third depth within said groove deeper than said second depth and achieving a final tensioning of said material.

6. A method for tensioning awning material, as recited in claim 5, wherein said step of securing said keeper member to said frame comprises the steps of drilling a passage in said frame, inserting a bolt through a hole in said keeper member and said passage in said frame, and securing said bolt to said frame.

7. A method for assembling an awning, comprising the steps of:

(a) assembling a frame;

(b) securing a first end of awning material to a first portion of said frame;

(c) stretching said awning material over a second portion of said frame; and (d) securing a second end of said awning material to said second portion of said frame, comprising the steps of:

i. placing a piece of resilient matter over a portion of said second end of said material;

ii. inserting said piece of resilient matter into a groove in said second portion of said frame to a first depth in said groove, thereby inserting said portion of said second end of said material into said groove in said frame, said resilient matter insertion step achieving an initial tensioning of said material;

iii. inserting a keeper member into said groove in said second portion of said frame so as to abut against said piece of resilient matter and urge said resilient matter to a second depth within said groove deeper than said first depth, said keeper member insertion step achieving a further tenisoning of said material; and iv. securing said keeper member to said frame, said keeper member securement step urging said spline to a third depth within said groove deeper than said second depth and achieving a final tensioning of said material.

8. A method for assembling an awning, as recited in claim 7, wherein said step of securing said keeper member to said frame comprises the steps of drilling a passage in said frame, inserting a bolt through said keeper member and said passage in said frame, and securing said bolt to said frame.

9. A method for tensioning awning material, comprising the steps of:

(a) securing a first end of said material to a first portion of a frame;

(b) stretching said material over a second portion of said frame; and (c) securing a second end of said material to said second portion of said frame, comprising the steps of:

i. placing a piece of spline over a portion of said second end of said material;

ii. inserting said spline into a groove in said frame to a first depth in said groove, said groove having a substantially uniform width, thereby inserting said portion of said second end of said material into said groove in said frame, said spline insertion step achieving an initial tensioning of said material; and iii. securing said keeper member to said frame so as to insert said keeper member into said groove to abut said spline, said keeper member securement step urging said spline to a second depth within said groove deeper than said first depth and achieving a final tensioning of said material.

10. A method for tensioning awning material, comprising the steps of:

(a) securing a first end of said material to a first portion of a frame;

(b) stretching said material over a second portion of said frame; and (c) securing a second end of said material to said second portion of said frame, comprising the steps of:

i. placing a piece of spline over a portion of said second end of said material;

ii. inserting said spline into a groove in said frame to a first depth in said groove, said groove having a substantially uniform width and said spline forming a tight interface fit within said groove, thereby inserting said portion of said second end of said material into said groove in said frame, said spline insertion step achieving an initial tensioning of said material;

iii. inserting a keeper member into said groove in said frame so as to abut said spline and urge said spline to a second depth within said groove deeper than said first depth, said keeper member insertion step achieving a further tensioning of said material; and iv. securing said keeper member to said frame, said keeper member securement step urging said spline to a third depth within said groove deeper than said second depth and achieving a final tensioning of said material.

* * * * *